US010738801B2

(12) United States Patent
Garbarino et al.

(10) Patent No.: US 10,738,801 B2
(45) Date of Patent: Aug. 11, 2020

(54) HYDRAULICALLY POWERED IMMERSIBLE PUMPING SYSTEM

(71) Applicant: BFS Industries, Critical Fuel Systems Division, Butner, NC (US)

(72) Inventors: Michael Garbarino, Raleigh, NC (US); Tom Garbarino, Raleigh, NC (US); Andrew Johnson, Raleigh, NC (US)

(73) Assignee: BFS Industries, Critical Fuel Systems Division, Butner, NC (US)

( * ) Notice: Subject to any disclaimer, the term of this patent is extended or adjusted under 35 U.S.C. 154(b) by 0 days.

(21) Appl. No.: 16/561,414

(22) Filed: Sep. 5, 2019

(65) Prior Publication Data

US 2020/0080575 A1 Mar. 12, 2020

Related U.S. Application Data

(60) Provisional application No. 62/729,653, filed on Sep. 11, 2018.

(51) Int. Cl.
*F15B 15/18* (2006.01)
*F04B 17/03* (2006.01)

(52) U.S. Cl.
CPC ..... *F15B 15/18* (2013.01); *F04B 17/03* (2013.01)

(58) Field of Classification Search
CPC .. F15B 15/18; F04B 17/03; F04B 9/10; F04B 23/04; F04B 23/021
See application file for complete search history.

(56) References Cited

U.S. PATENT DOCUMENTS

| | | | | |
|---|---|---|---|---|
| 1,197,755 | A | 9/1916 | Moller | |
| 1,669,309 | A | 5/1928 | Spillmann | |
| 2,383,840 | A | 8/1945 | Benckert | |
| 2,536,840 | A | 1/1951 | Cornell | |
| 3,114,384 | A | 12/1963 | Quase | |
| 3,518,836 | A | 7/1970 | Itokawa | |
| 3,742,172 | A | 6/1973 | Velez | |
| 3,910,728 | A | 10/1975 | Sloan | |
| 3,963,376 | A | 6/1976 | Miskin | |
| 4,060,841 | A | 11/1977 | Allen | |
| 4,230,422 | A * | 10/1980 | Brown | B65D 88/78 114/257 |
| 4,350,476 | A * | 9/1982 | Eller | F04B 49/24 417/304 |
| 4,422,829 | A | 12/1983 | Buchanan | |
| 4,529,359 | A | 7/1985 | Sloan | |
| 4,552,512 | A | 11/1985 | Gallup et al. | |
| 4,556,343 | A | 12/1985 | Cheung | |
| 4,569,640 | A | 2/1986 | Zimmern | |
| 4,662,386 | A | 5/1987 | Pedersen | |
| 4,786,239 | A | 11/1988 | Eberhardt | |
| 4,958,747 | A | 9/1990 | Sheets | |
| 5,495,725 | A | 5/1996 | Middlemiss | |
| 5,540,355 | A | 7/1996 | Hancock et al. | |

(Continued)

*Primary Examiner* — Thomas E Lazo
(74) *Attorney, Agent, or Firm* — Olive & Olive, P.A.

(57) ABSTRACT

A partially immersible system includes fuel burning equipment such as an electrical generator located above a flood plain. A hydraulic fluid pumping system is located above the flood plain, and is connected to an immersible hydraulically powered fuel pumping system, which includes hydraulic motors connected to pumps connected to a fuel tank and to the fuel burning equipment to supply fuel to the fuel burning equipment.

6 Claims, 1 Drawing Sheet

(56) References Cited

U.S. PATENT DOCUMENTS

| | | | | |
|---|---|---|---|---|
| 6,056,154 | A | 5/2000 | Fowler | |
| 6,868,986 | B1 | 3/2005 | Arnold | |
| 7,448,404 | B2 | 11/2008 | Samuelson et al. | |
| 7,597,215 | B2 | 10/2009 | Slieman | |
| 8,905,677 | B2 | 12/2014 | Hantz | |
| 9,151,248 | B2 * | 10/2015 | Lee | F02M 21/0245 |
| 9,751,606 | B2 * | 9/2017 | Lee | F04B 23/025 |
| 9,932,981 | B2 * | 4/2018 | Cosgrove | F04C 13/002 |
| 2013/0022480 | A1 | 1/2013 | Storts et al. | |

* cited by examiner

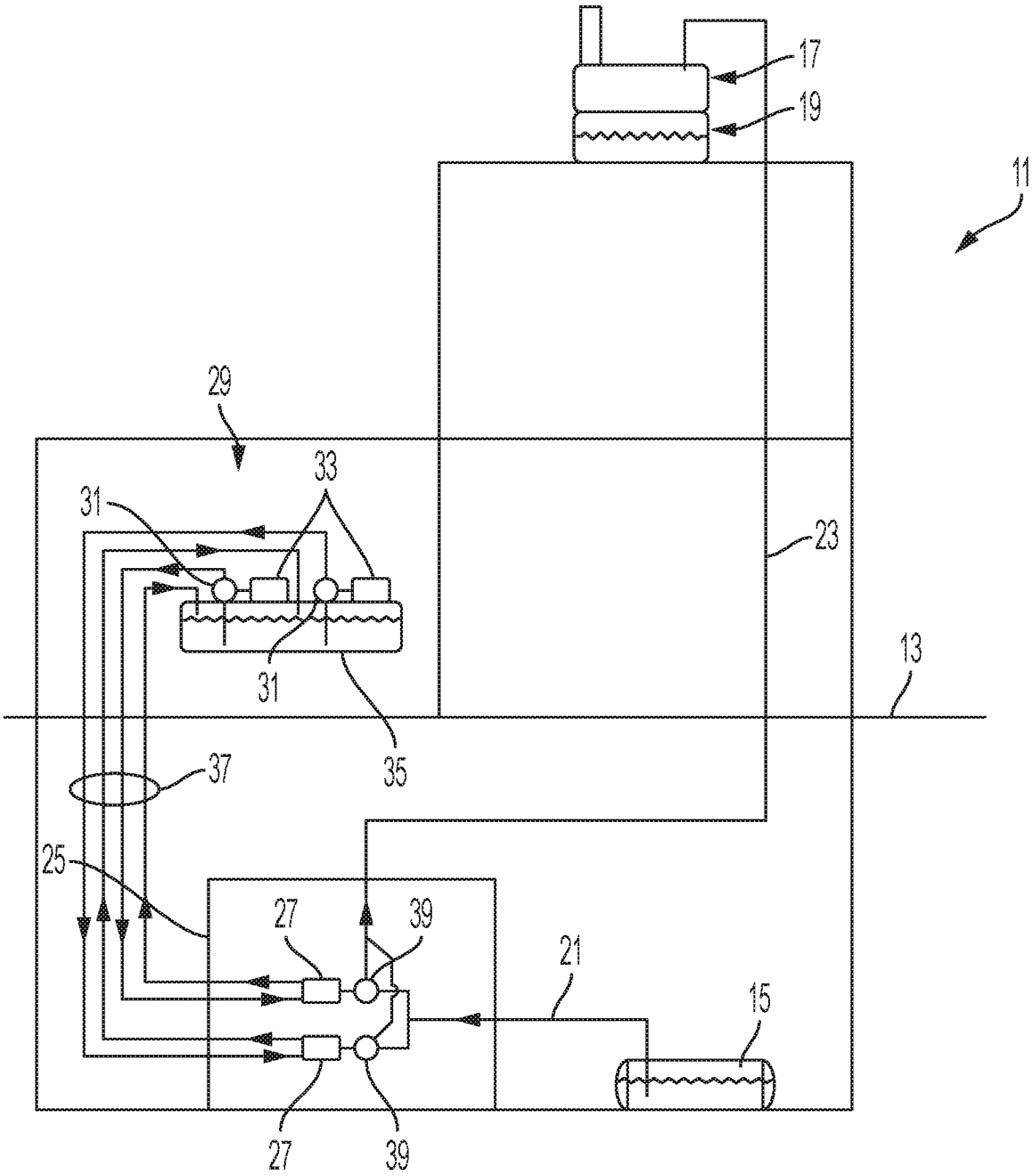
17
19
11
29
33
31
23
31
13
35
37
25
27
39
21
15
27
39

HYDRAULICALLY POWERED IMMERSIBLE PUMPING SYSTEM

CROSS-REFERENCE TO RELATED APPLICATIONS

This application is related to provisional application No. 62/729,653 filed on Sep. 11, 2018, and claims priority to the filing date thereof. The disclosure of provisional application No. 62/729,653 is specifically incorporated by reference herein in its entirety.

FIELD OF THE INVENTION

The invention relates to a system designed to overcome the problems that occur when flooding occurs due to, for example, a storm which results in equipment becoming immersed in water and becoming non-functional.

BACKGROUND OF THE INVENTION

Many buildings, and other locations have backup systems in the event of power loss. A standard installation that deals with typical power loss involves oil burning equipment, such as a backup generator or boiler, installed away from a main oil storage tank which is used to provide fuel to power the oil burning equipment. Such generators typically include a small local storage tank for the fuel or oil, and are located, for example, on a rooftop location above any flooding which may occur. Typically, when the generator burns most of its local fuel or oil, it sends a signal to a non-immersible electrically powered oil pumping system to cause additional oil from the main storage tank to be pumped to replenish the local storage tank, and keep the oil burning equipment running.

Typically, fuel oil stored in tanks for emergency generators have been located in the lowest levels of a building that may experience flooding. Because of the extreme weather conditions of the last half century, more installations have experienced flooding causing a failure of the generators coming online due to a lack of fuel.

More specifically, a problem with conventional systems, is that since the large oil tanks are often located at low elevations below a flood plain, electrically driven pumps, which are also located with the main storage tank containing fuel or oil, become flooded and destroyed. As a result it becomes impossible to keep the generators or boilers powered due to the inability to transfer oil from the main storage tank, which is underwater, to equipment requiring oil to run, such as backup generators or boilers.

One attempt to address these problems is provided by Preferred Utilities with its commercially available "water proof pump". An electrically driven pump is placed in an enclosure with a bolted cover at one end. The electrical service is brought from a controller above a flood plain. The system may be configured with just the pumps below in the flooded area. However, there is a serious concern about the bolted cover being maintained watertight over time, thereby allowing leaks, which will destroy the pumps.

It is thus an object of the present invention to overcome the problems of existing systems, to provide a system capable of keeping oil burning equipment such as generators and boilers running, notwithstanding the occurrence of extensive flooding at fuel supply sites for that equipment. The system of the invention as described herein will function under normal situations when the area is not experiencing any flooding. Only in extreme situations will the system be flooded, and the system will operate under flood conditions, as well as in a non-flooded state.

SUMMARY OF THE INVENTION

In accordance with the invention, there is provided a system having oil burning equipment or other fuel consuming equipment, such as a backup generator or boiler, installed away from a main oil storage tank and above a flood plain. A main fuel storage tank is typically located in a flood plain. The oil burning equipment, such as a backup generator or boiler, is installed above the flood plain so as to have little or no chance of ever being immersed as a result of flooding. The equipment may have a small local storage tank. When the equipment burns most of its local oil, it sends a signal to an electrically powered hydraulic pumping system, also located above the flood plain. The hydraulic pumping system pumps hydraulic fluid from its tank to an immersible hydraulic fuel pumping system. The pumped hydraulic fluid then spins hydraulic motors connected to oil pumps. The hydraulic system powering the oil pumps with hydraulic fluid causes oil from the main oil source tank to be pumped to the oil burning equipment, either directly to the oil burning equipment or to refill the local tank. Due to the way the system is arranged, no electricity is required at the flooded location.

In operation, the local tank, for example, at the backup generator or boiler may have a set of internal sensors which may operate to activate the system. The sensors may be wired to a local panel that sends a signal to controls for the system. In an alternative embodiment, the pump system may be commanded to turn on directly by a signal transmitted from the equipment requiring the fuel, e.g., the generator or boiler. In that case, there need not be a small local storage tank at the oil burning equipment. The equipment signals for oil exactly when it needs the oil. When the generator starts, it sends a signal to an electrically powered hydraulic pump above the flood plain to turn the hydraulic pump on. There may be a delay if the power actually goes out, but there is usually a large pipe full of fuel above the generator allowing it to fire and run until the refueling hydraulic pump is turned on.

BRIEF DESCRIPTION OF THE DRAWINGS

Having briefly described the invention the same will become better understood from the following description made with reference to the drawings wherein:

FIG. 1 is a schematic diagram of a typical building elevation view illustrating an embodiment of the system in accordance with the invention.

DETAILED DESCRIPTION OF REPRESENTATIVE EMBODIMENTS

In accordance with more specific aspects of the invention, there is provided a partially immersible system. Oil or other fuel burning equipment, such as a backup generator, is installed away from a main oil storage tank above a flood plain. The equipment may have a small local storage tank for oil, but this is not required. When the equipment burns most of its local oil, it may be configured to send a signal to an electronically powered hydraulic pumping system, also located above the flood plain. The hydraulic fluid pumping system is located at a high enough elevation to avoid being immersed in any flooding which occurs, and serves to pump hydraulic fluid from a tank to an immersible or immersed hydraulically powered fuel pumping system. The hydraulically powered fuel pumping system requires no electricity and spins hydraulic motors as a result of hydraulic fluid pumped thereto. The hydraulic motors are connected to oil pumps. The immersible or immersed pumping system then pumps oil or fuel from a main oil storage tank to the oil burning equipment directly, or to refill a local storage tank. No electricity is required below the flood plain irrespective of whether the equipment is underwater or above water.

The system is preferably used in an environment in which fuel or oil pump sets are provided that pump fuel, such as diesel fuel, to emergency generators. Such emergency generators are found at hospitals, banks, data centers, governmental facilities, or any place that cannot be allowed to stop operating due to an interruption in electrical service. In accordance with a specific aspect of the invention, the pump sets will be below the flood plain.

A hydraulically powered fuel pumping system is provided which can be immersed in water. An electrically driven hydraulic pump is located above a flood plain, with a small hydraulic storage tank connected thereto. A pump set is provided which uses hydraulic drive units to turn a pump head. The fuel pump set is located below the flood plain in a location such as a basement. This requires three connections: a supply, a return, and an emergency relief vent back to the storage tank. Everything is designed to work underwater and may be at a depth of a few feet up to about 90 feet of maximum depth. Hydraulic motor drive pumps run at all times, whether in normal conditions or in an emergency flood situation. The pump sets are preferably redundant with two pumps so that two hydraulic motor units are required, but the system can be designed for use with one common hydraulic storage tank.

Having generally described the invention, additional details are provided in the following description made with reference to FIG. 1.

FIG. 1 illustrates a system 11 in accordance with the invention. A flood plain line 13 is designated to show that certain components of the system 11 may be located below the flood plain line 13 and others are required to be above the flood plain line 13. A main fuel or oil storage tank 15 is located below the flood plain line 13 and serves to supply fuel to equipment, for example, equipment requiring oil or other fuel to operate such as an emergency generator 17 located, for example, on the roof of a hospital during a time when power is lost. The storage tank 15 containing oil or fuel is connected through transmission conduits 21 and 23 indirectly through a hydraulically powered fuel pump system 25 to the equipment requiring oil, e.g., a generator 17. In the event of a flood, oil can still be supplied to the equipment requiring oil 17 directly, or to its own fuel or oil supply tank 19 (local tank) by powering an electric hydraulic fluid pumping system 29 located above the flood plain line 13. The electric hydraulic pumping system 29 includes electric motors 33 which drive hydraulic pumps 31, and which draw hydraulic fluid from a hydraulic fluid storage tank 35 and pumps it through hydraulic fluid conduits 37 to the hydraulically powered fuel pump system 25. The hydraulically powered fuel pump system 25 includes redundant hydraulic motors 27 which are driven by the hydraulic fluid pumped thereto to operate oil pumps 39, also consisting of a pair of pumps 39, to draw oil from main oil or fuel source tank 15 through conduit 21 and through the oil pumps 39 into line 23 to feed the equipment 17 requiring oil or fuel.

While not shown, the electrically powered hydraulic pumping system 29 can be powered by the generator 17 or other electrical supply such as batteries, etc.

Thus, as may be appreciated from the foregoing description, the system 11 of the invention may be installed in any location that may experience flooding. Any building that has deep sub-basements will on occasion experience flooding when sump pumps are unable to keep up with the flow of water. Once the sump pumps are flooded, it may take a while to pump out the water to be able to access fuel oil pumps in the sub-basement for repair or replacement.

Another example is use of the system 11 in buildings that have generators located on the ground floor with either buried or above ground main storage tanks. In these applications the pump set is normally also located on the ground floor. As a result, a major storm can cause flooding in the area that will flood the pump set and cause a failure. In some applications, the solution is to place the generator on the second or third floor, but the pump set may have to stay on the ground level to be close to the main oil or fuel tank. In summary, the system 11 of the invention is used wherever a pump set might be flooded. With the advent of climate change, it is expected the requirement will grow for this type of system.

As may be appreciated, the following are some features and benefits resulting from the system 11 of the invention.

| FEATURE | BENEFIT |
|---|---|
| All components are visible with no special tools or kits required | Easy to periodically inspect |
| Waterproof to 90 feet | Handles virtually all applications |
| Optional leak and flow sensors cut off in a flood | During flood, no concern with electrical shorts in flooded area affecting the controls above |
| Flood sensor | Allow the building to know that flooding is occurring in the basement |
| No risk of operator leaving the cover off | No chance flooding protection will be compromised |
| Available in sizes from 80 gph to 3050 gph with standard pressures of 50, 100, and 150 psi. Custom sizes also available | Covers a wide range of applications |
| Optional SS Flex Hoses for the hydraulic supply and return along with fuel oil connections | Longer life with isolation of any system induced vibration |
| No electrical power equipment located at the flooded area | Electrical safety |
| Corrosion for salt water or other corrosive fluids in the flood water will not affect operation | The system can run in all types of polluted water for extended periods of time |
| Available with relief valves (internal or external) | Protection for the system from flow restriction in the system |

-continued

| FEATURE | BENEFIT |
|---|---|
| Standard controls packages include complete PLC/HMI based systems; others are available | Flexible to meet the requirements of the application and control system |
| Available with single hydraulic pumps | Cost saving |
| Strainers to protect fuel oil pumps, filters to protect hydraulic pumps | Long term reliability |
| Factory tested with both hydraulic oil and mineral oil substituting for the fuel oil (diesel). Controls completely checked and inspected | Ready to go once in the field, no gaskets to possibly leak and control wiring and programming all checked out to minimize start up and commissioning time. Only field checkout required is pump rotation on three phase systems |
| All systems are protected with base pans | Minimizes leaks of both diesel and hydraulic oil |
| Ecologically Friendly Hydraulic Fluid is available | Reduces the pollution risks from this system |

Having thus broadly described the invention the same will become better understood from the appended claim in which it is described in a non-limiting manner.

What is claimed is:

1. A system for maintaining equipment requiring fuel to operate, the system comprising:

equipment requiring fuel to operate located at a height above which flooding occurs, said equipment having a fuel source connected thereto for supplying fuel to operate the equipment;

at least one fuel source tank comprising said fuel source and located at a height below which flooding occurs;

at least one hydraulic motor, and at least a first fuel pump connected to the hydraulic motor for being driven to operate by the hydraulic motor, said at least a first fuel pump connected to said at least one fuel source tank and to the equipment requiring fuel to operate; and at least one electric motor and a second hydraulic pump located at a height above which flooding occurs, said at least a second hydraulic pump connected to at least one electric motor and to a source of hydraulic fluid and to said at least one hydraulic motor to cause the hydraulic motor to operate and cause the at least a first fuel pump to pump fuel from said at least one fuel source tank to the equipment requiring fuel to operate.

2. The system of claim 1, further comprising a limited capacity fuel tank connected to the equipment requiring fuel to operate, and said limited capacity fuel tank indirectly connected through a pump to the at least one fuel tank.

3. The system of claim 1, wherein the equipment requiring fuel to operate comprises an electric generator.

4. The system of claim 1, wherein the equipment requiring fuel is a boiler.

5. The system of claim 1, wherein the at least one hydraulic motor and at least one fuel pump connected to the at least one hydraulic motor comprise two hydraulic motors and two fuel pumps.

6. The system of claim 1, wherein the at least one electric motor and the at least a second hydraulic pump comprise two electric motors and two hydraulic pumps.

* * * * *